US008491400B2

(12) United States Patent
Kempf

(10) Patent No.: US 8,491,400 B2
(45) Date of Patent: Jul. 23, 2013

(54) UNIVERSAL DECK TRACK DOG WITH REPLACEABLE PARTS

(75) Inventor: James Kempf, Wallkill, NY (US)

(73) Assignee: Production Resource Group, LLC, New Windsor, NY (US)

( * ) Notice: Subject to any disclaimer, the term of this patent is extended or adjusted under 35 U.S.C. 154(b) by 325 days.

(21) Appl. No.: 12/946,512

(22) Filed: Nov. 15, 2010

(65) Prior Publication Data

US 2011/0118038 A1 May 19, 2011

Related U.S. Application Data

(60) Provisional application No. 61/261,264, filed on Nov. 13, 2009.

(51) Int. Cl.
*A63J 1/02* (2006.01)
*A63J 5/00* (2006.01)

(52) U.S. Cl.
USPC ..... 472/79; 472/81

(58) Field of Classification Search
USPC ..... 472/57, 74–81, 136; 52/6–8
See application file for complete search history.

(56) References Cited

U.S. PATENT DOCUMENTS

| | | | | |
|---|---|---|---|---|
| 2,507,857 | A * | 5/1950 | Johnson | 40/624 |
| 2,602,196 | A * | 7/1952 | Pelton | 52/6 |
| 4,090,692 | A * | 5/1978 | Jacobs | 472/78 |
| 4,606,527 | A * | 8/1986 | Ziller et al. | 254/336 |
| 4,662,628 | A * | 5/1987 | Chatenay epouse Compagnone | 472/77 |
| 4,795,405 | A * | 1/1989 | Davis | 472/78 |
| 5,323,564 | A * | 6/1994 | Mensching et al. | 52/7 |
| 5,711,713 | A * | 1/1998 | Krueger | 472/77 |
| 6,547,670 | B1 * | 4/2003 | Kempf | 472/77 |

* cited by examiner

*Primary Examiner* — Kien Nguyen
(74) *Attorney, Agent, or Firm* — Law Office of Scott C. Harris, Inc.

(57) ABSTRACT

A track dog with removable parts. Embodiments describe one or more of the following features. In one embodiment, the size of the receiver for the knife shaped piece can be variable. Another embodiment describes an improved technique of holding the cable that is run under the floor. Yet another embodiment describes a device where the cable attachment mechanism are set in a location that line up with the openings in the floor to allow tightening without opening the floor. Another aspect describes a special through hole so that cable can be run through the device, e.g., to connect to another track dog.

20 Claims, 4 Drawing Sheets

UNIVERSAL DECK TRACK DOG WITH REPLACEABLE PARTS

This application claims priority from provisional application No. 61/261,264, filed Nov. 13, 2009, the entire contents of which are herewith incorporated by reference.

BACKGROUND

In a stage environment, it may be useful to move scenery. Often, a deck track is used to move the scenery, where the deck track is placed in the floor, and a "dog" extends from the machinery into the floor area. A winch is used to move one or more cables that run under the floor in order to move the scenery along the track.

SUMMARY

An embodiment describes a special deck track dog which has a number of different features.

Embodiments describe one or more of the following features. In one embodiment, the size of the receiver for the knife shaped piece can be variable.

Another embodiment describes an improved technique of holding the cable that is run under the floor.

Yet another embodiment describes a device where the cable attachment mechanism are set in a location that line up with the openings in the floor to allow tightening without opening the floor.

Another aspect describes a special through hole so that cable can be run through the device, e.g., to connect to another track dog.

DETAILED DESCRIPTION

A new universal deck track dog is described. An embodiment has advantages over many existing items including: changeable length "ears" that normally are permanently welded, the ability to clamp to four sizes of cable with changeable grips compared to only a single cable choice, the ability to loosen the grip and slide the dog in the track and then retighten (a feature which others cannot easily do), a return cable bore for cable that travels through the bore supporting a second dog operating in the same track, and accessory mounting holes for use with changeable shoes and sleds. Embodiments as described herein may carry out one or more of these features.

Figure 1A:
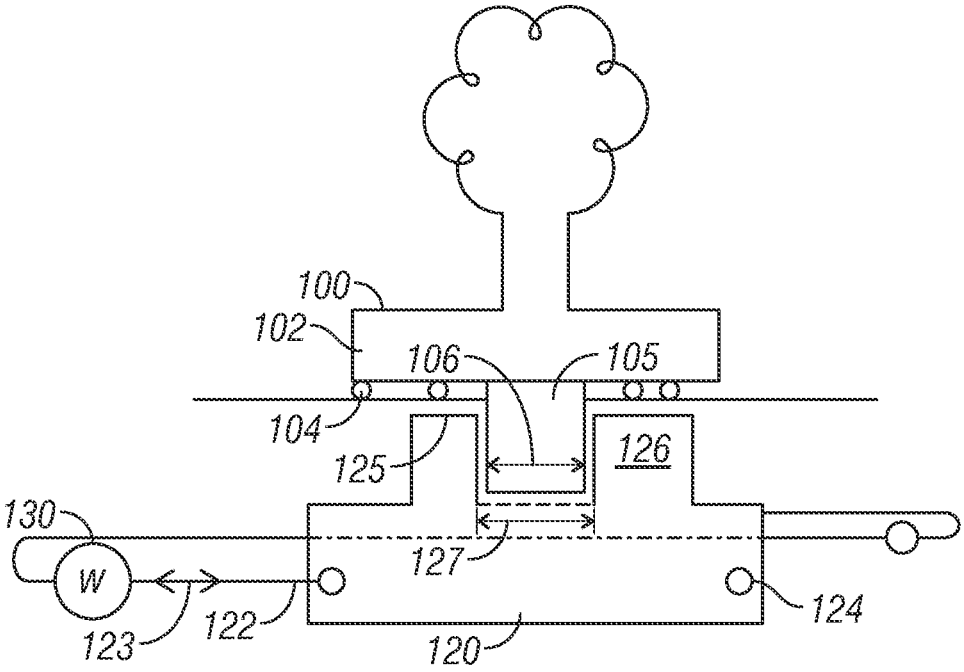
FIGS. 1A and 1B show use of the improved deck track dog within a deck of the stage.
Figure 1B:
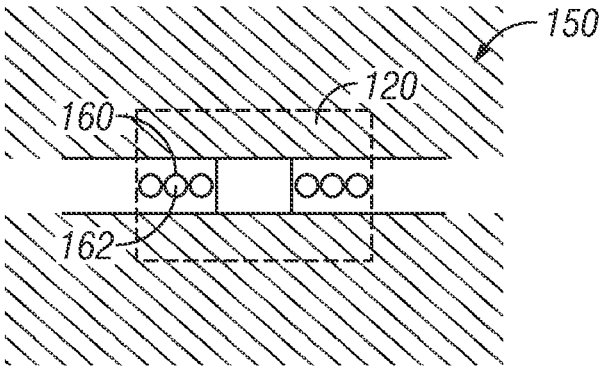

An embodiment is shown in FIGS. 1A and 1B. FIG. 1A shows a side view showing a piece of scenery 100 that is movable on the stage. The scenery 100 is mounted on the base 102. A portion of the scenery mates with the stage, and is movable along the track. The track dog 120 is shown connected to cables 122, 124 to a winch 130 that drives the cable. This allows the cable to be moved in the direction of the arrows 123, thereby moving the scenery back and forth along the track as desired. The scenery includes a blade 105 that is rigidly attached thereto. The blade has a width shown as 106. The width is formed between inner surfaces of two holding portions on the dog, shown generically as 125 and 126. The holding portions also define an area therebetween shown as 127.

FIG. 1B shows the dog 120 under the stage floor 150. The dashed line portions of the dog 120 represent the body of the dog as under the stage floor. It can be seen that a portion of the dog 120, shown in FIG. 1B as 160, is accessible through the stage floor. That portion includes a number of set screws 162, 163 as described herein.

Figure 2:
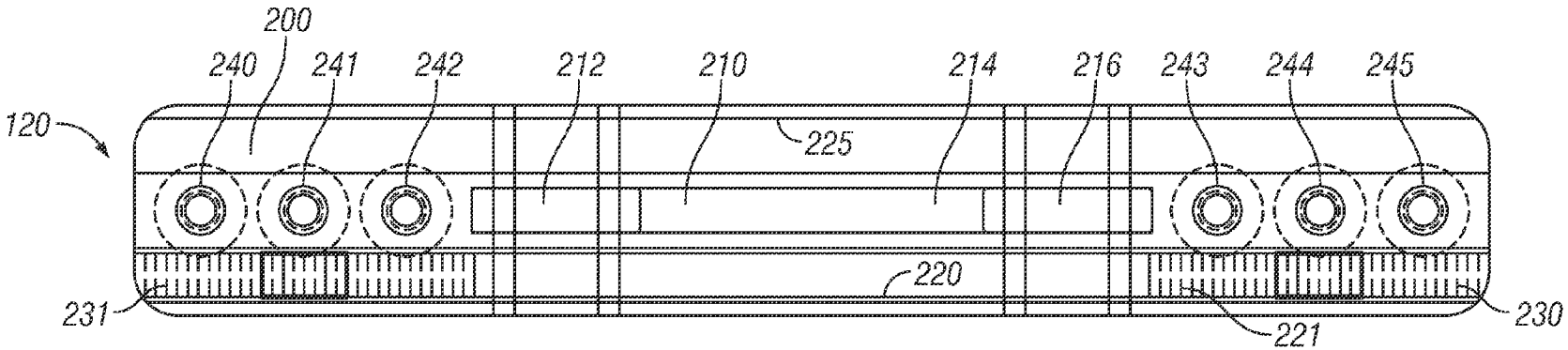
FIG. 2 shows a plan view of the track dog according to an embodiment.

FIG. 2 shows a detailed plan view of the dog device. The dog includes a body 200 which includes a receiver 210 for a knife blade from scenery or other device to be moved along the track. The receiver 210 includes first and second ears with a first ear 212 on one side of the opening 200 and a second ear 216 on the other side of the opening 214. The space between the ears defines the size of the opening for the knife that is attached to the scenery.

In an embodiment, this can be sized to hold a standard 2 inch knife.

The dog also includes first and second cable locations, including a first cable conduit location 220 shown with the cable 221 therein. The cable 221 is held by cable grippers at the locations 230 and 231 as described herein. Set screws 240, 241, 242, 243, 244 are used to hold the cable in place. The cable is run through the cable conduit 220 at an off-center location. The receiver 210 is at the center of the device. Another off-center location, which is symmetric to the off-center location of cable conduit 220, forms a second cable conduit 225. A cable can pass through the second conduit area 225 without being held by the dog, and therefore can pass freely through it. For example, in one embodiment, there can be two dogs in the same track, with the cable for the further-placed dog passing through the second conduit area 225 of the closer-placed dog.

Figure 3:
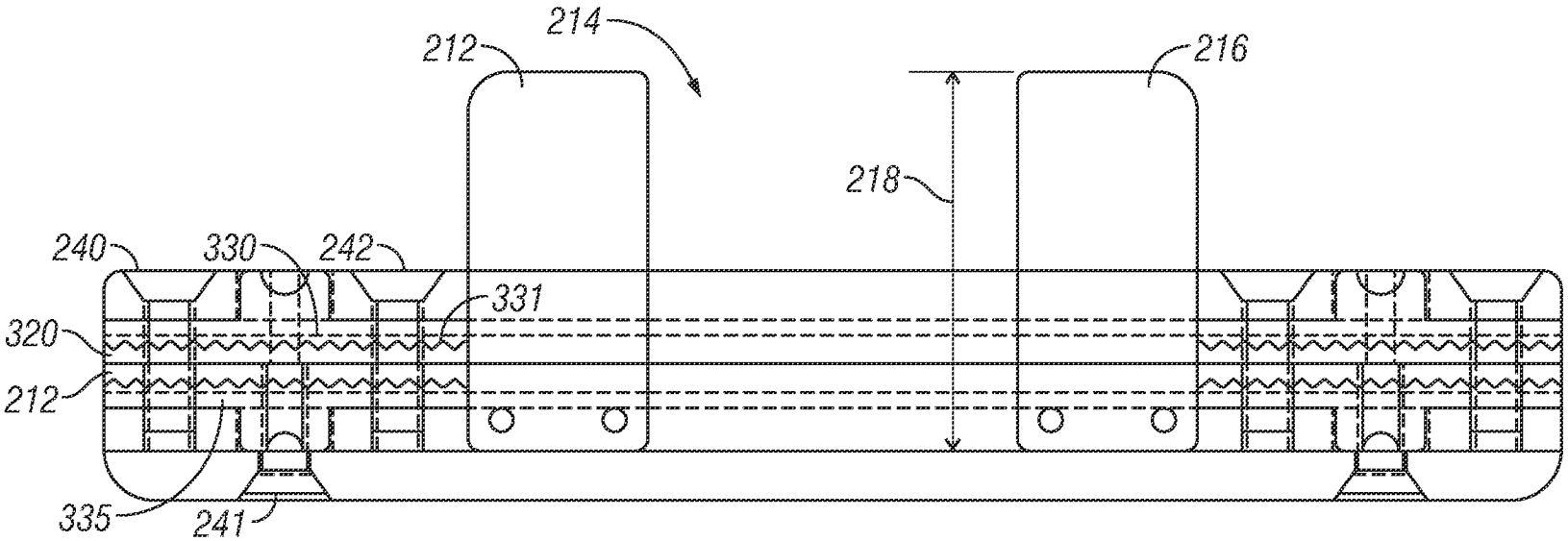
FIG. 3 shows a front view of an embodiment.

FIG. 3 illustrates a front view of the track dog body. This shows the dog ears 212, 216 which are spaced by 2 inches to form the opening 214. The ears also have a height shown generally as 218, where the height is from the bottom of the ear to the top of the ear. In the embodiment, different ears can be used to define different heights and the ears are removable and replaceable to put different ears with different heights on the dog.

FIG. 3 shows the winch cable 320 being held between first and second grippers 330, 335. The grippers have, as explained herein, serrated contact surfaces shown as 331 that generally hold the cable along a certain length of the cable. In an embodiment, the grippers are replaceable. Different thickness grippers can be used to hold different amounts of the cable.

Set screws 240, 241 and 242 are also shown in countersink holes, and as explained herein are in a location so that they can be tightened through the opening in the stage without opening the stage itself. More generally, however, the set screws can be any device which increases and decreases the tightness of the grippers against the cable.

Figure 4:
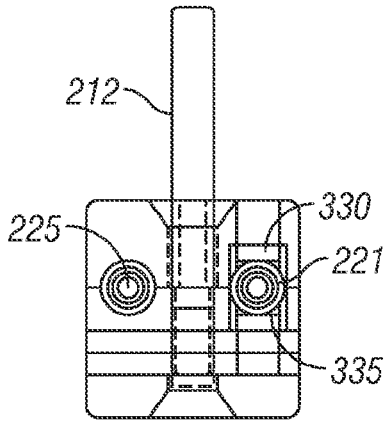
FIG. 4 shows a side view of an embodiment.

FIG. 4 shows a side on view of the device, showing the dog ears 212, the cable 221 and grippers 330 and 335 holding the cable therebetween, as well as the second cable conduit 225 with cable passing therethrough without being gripped.

Figure 5A:
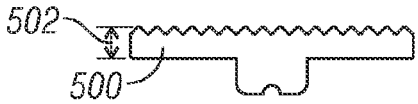
FIGS. 5A-5D show the different grips which can be used to grip the cable according to the embodiment.

FIGS. 5A-5D show the different grips which can be used according to the present system, to grip the cable in different ways. Each of the grips are substantially 2 inches in length, to hold the cable over that 2 inch length. However, different grips have different thicknesses. For example, FIG. 5A shows a first grip that is intended for gripping ⅛ inch cable. This grip 500 has a thickness 502 so that the distance between two of the grips is appropriate for gripping the ⅛ inch cable.

Figure 5B:
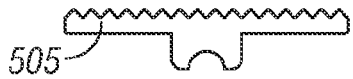
Figure 5C:
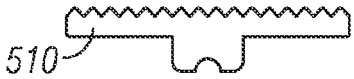
Figure 5D:
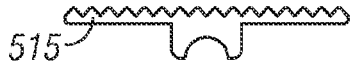

In a similar way, the other grips are intended for gripping different cables, with grip 505 shown in FIG. 5B being for ¼ inch cable, grip 510 in FIG. 5C being for 3/16 cable and grip 515 being a 5/16 gripper. Note that each of the grips include an indented portion 501 at the bottom, which interacts with the set screw.

Figure 6:
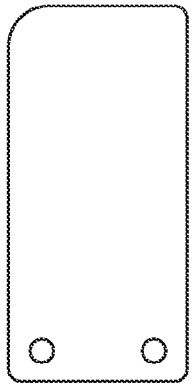
FIG. 6 shows a plan view of the dog "ears" that can be used according to embodiments.

FIG. 6 shows a detailed view of the dog ear, which is formed from quarter inch steel. Different dog ears can be formed at different thicknesses to be used on different thickness stage floors.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other configurations for other applications are possible.

Also, the inventor intends that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A holder for movable items on a stage floor, comprising:

a housing, having a top surface and having a connection to a cable;

first and second removable ears, said removable ears extending above the top surface of the housing, said removable ears being located to define a space between the removable ears, with a first surface on a first side surface of the first removable ear, a second surface on a second side surface of the second removable ear that faces the first removable ear, and an opening between said first and second side surfaces; and a connection for a cable gripping part inside said housing, said cable gripping part also being removable and replaceable.

2. A holder as in claim 1, further comprising a settable pressure adjustment device, which is changeable for adjusting a distance between two of said cable gripping parts, to tighten said cable gripping parts against the cable which passes through said housing.

3. A holder as in claim 2, wherein said cable gripping parts include a first set of cable gripping parts sized to grip a first diameter cable and a second set of cable gripping parts which is sized to grip a second diameter cable different than the first diameter cable.

4. A holder as in claim 1, wherein said removable ears are sized and located to fit through an opening in the floor.

5. A holder as in claim 4, wherein said cable gripping part is adjustable, and is located in a location where at least part can be adjusted through the opening in the floor.

6. A device as in claim 4, further comprising a third and fourth different length ears, that can be changed with said first and second removable ears to provide different length ears.

7. A device as in claim 1, wherein said cable passes to a first location where said cable gripping parts are located.

8. A device as in claim 7, further comprising a second location, symmetrical in said housing to said first location, and sized to allow the cable to pass therethrough, said second location not gripping said cable but allowing said cable to pass through the second location.

9. A method, comprising:

using a track dog device to move a moveable device, by extending a part of the track dog device through an opening in a stage floor;

enabling tightening of a connection between the track dog device and a cable which drives the track dog device through the opening in the stage; and changing at least one size of one item in the track dog device to allow the track dog device to work with a different size item.

10. A method as in claim 9, further comprising gripping the cable along an area of the cable using a gripper that is tightened by said tightening.

11. A method as in claim 10, wherein said changing comprises using a different size cable in the track dog device, and changing a thickness of said gripper which holds the track dog cable, where said tightening tightens an amount of gripping by said gripper.

12. A method as in claim 10, wherein said area is a 2 inch length of said cable.

13. A method as in claim 9, wherein said part of the track dog device is a dog ear of the track dog device, further comprising a second track dog with a second dog ear, and where said changing the size comprises using a cavity in between said dog ear and said second dog ear to hold said item.

14. A method as in claim 13, wherein said dog ear holds said item using a 2 inch opening forming said cavity.

15. A method as in claim 9, further comprising allowing another cable to pass through a housing holding said gripper without gripping said other cable.

16. A holder for movable items on a stage floor, comprising:

a housing, having a top surface and having a first connection to a cable gripping part inside said housing, said cable gripping part also being removable and replaceable, and a second area through which a second cable passes through said housing without being gripped by said housing; and scenery moving ears extending above the top surface of the housing, said ears being located to define a space therebetween, intended to hold stage scenery.

17. A holder as in claim 16, wherein said ears are removable and replaceable with different size ears.

18. A holder as in claim 16, wherein said cable gripping part is removable and replaceable with a different gripping part intended for gripping a different size cable.

19. A holder as in claim 18, wherein said cable gripping parts include a first set of cable gripping parts sized to grip a first diameter cable and a second set of cable gripping parts which is sized to grip a second diameter cable different than the first diameter cable.

20. A holder as in claim 16, wherein said ears are sized and located to fit through an opening in the floor.

* * * * *